US011338343B2

(12) United States Patent
Xu et al.

(10) Patent No.: US 11,338,343 B2
(45) Date of Patent: May 24, 2022

(54) TORSION SHAFT STRUCTURE BASED MULTI-LINK ALL-ELECTRIC SERVO SYNCHRONOUS BENDING MACHINE

(71) Applicant: NANJING UNIVERSITY OF POSTS AND TELECOMMUNICATIONS, Nanjing (CN)

(72) Inventors: Fengyu Xu, Nanjing (CN); Yuxuan Lu, Nanjing (CN); Sen Yang, Nanjing (CN); Guoping Jiang, Nanjing (CN); Min Xiao, Nanjing (CN)

(73) Assignee: NANJING UNIVERSITY OF POSTS AND TELECOMMUNICATIONS, Nanjing (CN)

( * ) Notice: Subject to any disclaimer, the term of this patent is extended or adjusted under 35 U.S.C. 154(b) by 182 days.

(21) Appl. No.: 16/759,101

(22) PCT Filed: Sep. 10, 2019

(86) PCT No.: PCT/CN2019/105046
§ 371 (c)(1),
(2) Date: Apr. 24, 2020

(87) PCT Pub. No.: WO2021/012361
PCT Pub. Date: Jan. 28, 2021

(65) Prior Publication Data

US 2021/0402450 A1 Dec. 30, 2021

(30) Foreign Application Priority Data

Jul. 22, 2019 (CN) ..... 201910661872.5

(51) Int. Cl.
*B21D 5/02* (2006.01)
*B21D 5/00* (2006.01)
*B21D 37/12* (2006.01)

(52) U.S. Cl.
CPC ..... *B21D 5/0209* (2013.01); *B21D 5/004* (2013.01); *B21D 37/12* (2013.01)

(58) Field of Classification Search
CPC ..... B30B 15/148; B30B 1/02; B30B 1/06; B30B 1/10; B30B 1/14; B30B 1/103;
(Continued)

(56) References Cited

U.S. PATENT DOCUMENTS

2005/0109229 A1* 5/2005 Hasegawa ..... B29C 33/22 101/480
2010/0282098 A1* 11/2010 Yamasaki ..... B30B 1/106 100/287

FOREIGN PATENT DOCUMENTS

CN 2642425 Y * 9/2004

OTHER PUBLICATIONS

CN2642425 Yuepeng (Sep. 22, 2004) MT (Year: 2004).*
(Continued)

*Primary Examiner* — Adam J Eiseman
*Assistant Examiner* — Fred C Hammers
(74) *Attorney, Agent, or Firm* — CBM Patent Consulting, LLC

(57) ABSTRACT

A torsion shaft structure based multi-link all-electric servo synchronous bending machine, comprising a machine frame, a lower die fixedly connected to the machine frame and used for bending, a slider capable of moving up and down along the machine frame, and an upper die fixedly connected to the slider and cooperating with the lower die to perform bending, wherein the slider is left-right symmetrically connected to drive mechanisms for driving the slider to realize a transmission ratio adjustable motion.

5 Claims, 16 Drawing Sheets

(58) Field of Classification Search
CPC ..... B21D 5/00; B21D 5/02; B21D 5/0209; B21D 5/04
USPC ..... 72/450, 451
See application file for complete search history.

(56) References Cited

OTHER PUBLICATIONS

Practical Machinist, post 15, Google search (Jan. 15, 2006) (URL on document) (website accessed Jan. 28, 2022) (Year: 2006).*
Practical Machinist, post 15 (https://www.practicalmachinist.com/vb/general-archive/mounting-motor-hinged-plate-73261/) (Jan. 16, 2006) (website accessed Jan. 28, 2022) (Year: 2006).*

* cited by examiner

TORSION SHAFT STRUCTURE BASED MULTI-LINK ALL-ELECTRIC SERVO SYNCHRONOUS BENDING MACHINE

TECHNICAL FIELD

The present invention relates to a plate bending machine, in particular to a torsion shaft structure based multi-link all-electric servo synchronous bending machine.

BACKGROUND

A numerical control bending machine is a most important and most basic device in the field of metal plate machining. Energy saving, environmental protection, high speed, high precision, numeralization and intelligence are development trends in the future. The drive mode of the numerical control bending machine consists of hydraulic drive and mechanical electric servo drive, wherein the hydraulic drive mode is adopted in most cases. However, the mechanical electric servo drive mode is a development trend in the future.

The hydraulic drive has the advantages of large tonnage, and being easy to bend a large breadth and thick plate; the hydraulic drive has several disadvantages as follows: 1, high noise, high energy consumption, hydraulic oil leakage and environmental pollution; 2, the cost is high because the costs of high precision components such as a hydraulic ram, a valve group, a hydraulic pump and the like are high, wherein the high end markets of the valve group and the hydraulic pump are almost completely dependent on imports, and have costs; 3, the precision is low; a hydraulic system has an inherent disadvantage in position precision control, and therefore the position controllability is poor; 4, the service life is short because the abrasion of elements and components and the pollution of a hydraulic oilway are both easy to generate an adverse effect on the stability of the hydraulic system; 5, the actions of the slider have big impact, and are not gentle; 6, the hydraulic drive mode is greatly influenced by the factors such as ambient temperature, humidity, dust and the like; and 7, motion control is complex.

The mechanical electric servo drive mode can overcome the defects of the hydraulic drive mode. However, the mechanical electric servo drive mode has a technical bottleneck, and therefore can only be used in the field of small tonnage not greater than 50 tons. At present, the driving mode of a small tonnage mechanical all-electric servo bending machine is as shown in FIGS. 1 and 2. Most bending machines adopt a heavy load ball screw drive mode, and mainly consist of a servo motor a, synchronous belt transmission b, a ball screw transmission c, a slider d, a workbench e and the like, wherein the servo motor is fixed on a machine frame; the ball screw is hingedly connected to the machine frame; the slider is slidably connected to the machine frame, and can slide up and down along the machine frame; and the workbench is fixed on the machine frame. The synchronous belt transmission consists of three parts: a small belt wheel, a synchronous belt and a big belt wheel, and plays the roles of deceleration and transmission. The slider is driven by a ball screw transmission pair; the servo motor drives the ball screw to rotate via the synchronous belt; and the slider moves up and down under the driving of the ball screw transmission pair. The slider d moves up and down relative to the workbench e; an upper die f is mounted on the slider, and a lower die g is mounted on the workbench, in which way a plate h is bent. The slider is driven by two left-right symmetrically arranged lead screws. On one hand, the load is heavy and the rigidity is high; on the other hand, when the upper die and the lower die have a parallelism error therebetween, the parallelism can be fine-adjusted by means of the reverse rotation of two left and right motors.

The mechanical all-electric servo bending machine in the ball screw drive mode has the advantages of simple structure, high mechanical transmission efficiency, fast speed, high precision and effectively overcoming various problems of the hydraulic transmission; the disadvantages are as follows: 1, high cost, high precision, and high price because the heavy load ball screw is basically dependent on imports; 2, the machining precision of a machine tool is high; 3, the ball screw drive mode is only suitable for small tonnage bending machines; 4, the power utilization ratio is low; the drive motor is required to have a high power; and the cost is high; 5, the lead screws are easy to wear and damage.

As for the power utilization ratio, the power consumed by the servo motor during practical use is determined by load; the ratio of the power consumed during practical use to a maximum power index (or rated power) that the motor can achieve can be used as the power utilization ratio. Generally, during plate bending, the bending machine sequentially experiences three stages: 1, fast downward stage: the slider moves downward from an upper dead point until the upper die contacts the plate, in which process the speed is fast and the load is small; the speed is generally in the range of 150 mm/s-200 mm/s; the load is basically the overcome gravity of the slider; the gravity of the slider generally does not exceed 1/50 of a nominal bending force of the bending machine, and therefore, the load is small; the fast downward stage is a typical high speed and low load stage; 2, machining stage: the bending machine bends the plate; the machining stage is a typical low speed and high load stage; the speed is about 20 mm/s which is about 1/10 of the fast downward speed; 3, return stage: after the plate is bent, the slider moves upward and returns to the upper dead point; the speed and load are the same as that in the fast downward stage; the return stage is a high speed and low load stage.

Therefore, the operating condition of the bending machine is a typical variable speed and variable load operating condition. Since the transmission ratio of ball screw transmission is fixed, the servo motor reaches the maximum rotating speed $n_{max}$ in the fast downward stage, but is far from reaching the peak torque $M_{max}$. According to empirical data, the reached torque is generally only 1/50 of the peak torque. Therefore, the load can be directly used as an output torque of the motor. That is, the power to be consumed by the motor in the fast downward stage is:

$$P = n_{max} \times \frac{M_{max}}{50} = \frac{1}{50} p_{max}.$$

In the machining stage, the motor reaches the peak torque $M_{max}$. However, according to empirical data, the rotating speed of the motor is only 1/10 of the maximum rotating speed $n_{max}$; mainly considering safety factors, the machining speed of the bending machine is usually low, and the power required by the motor in the stage is:

$$P = \frac{1}{10} n_{max} \times M_{max} = \frac{1}{10} p_{max}.$$

Therefore, a drive system not only needs to satisfy the maximum rotating speed requirement in the fast downward and return stages, but also needs to satisfy the peak torque requirement in the machining stage. Under the premise that the transmission ratio is fixed, the peak power is $P_{max}=n_{max}\times M_{max}$. The drive motor is required to have a high power. However, the motor does not reach the maximum peak power during practical use. Therefore, the power of the motor is not fully used, that is, the power utilization ratio is low. Taking a common 35t mechanical electric servo bending machine on the present market as an example, the fast downward speed and return speed thereof are generally 200 mm/s, and the nominal bending force is 350 kN. In order to satisfy the requirements for both the maximum speed and the maximum bending force, two 7.5 kW servo motors are usually adopted. According to the conventional configurations on the present market, during practical operation, the power actually consumed by the two servo motors is about 1 kw-2 kW, and therefore the power utilization ratio is extremely low.

Therefore, the above problems are urgent to be solved.

SUMMARY OF THE INVENTION

Object of invention: the object of the present invention is to provide a torsion shaft structure based multi-link all-electric servo synchronous bending machine which is suitable for large tonnage and ensures a slider to have a nonlinear motion and mechanical characteristic while utilizing a nonlinear motion characteristic and a specific position self-locking characteristic of a link mechanism.

Technical solution: to achieve the above object, the present invention discloses a torsion shaft structure based multi-link all-electric servo synchronous bending machine, comprising a machine frame, a lower die fixedly connected to the machine frame and used for bending, a slider capable of moving up and down along the machine frame, and an upper die fixedly connected to the slider and cooperating with the lower die to perform bending, wherein the slider is left-right symmetrically connected to drive mechanisms for driving the slider to realize a transmission ratio adjustable motion.

Wherein the drive mechanisms comprise a power assembly located on the machine frame, a screw driven by the power assembly, a nut in thread fit with the screw, a rotatable torsion shaft disposed perpendicular to a slider plate surface and hingedly connected to the machine frame, a first crank having one end hingedly connected to the nut and the other end fixedly connected to the torsion shaft, and a second crank having one end fixedly connected to the torsion shaft and the other end hingedly connected to the slider via the first link; the power assembly outputs power, drives the screw to rotate, drives the nut to move via a screw thread pair transmission, and drives the slider to move up and down sequentially via the first crank, the torsion shaft, the second crank and the first link.

Preferably, the drive mechanisms comprise a power assembly located on the machine frame, a screw driven by the power assembly, a nut in thread fit with the screw, a tripod having one end hingedly connected to the nut and the other end hingedly connected to the machine frame, a rotatable torsion shaft disposed perpendicular to a slider plate surface and hingedly connected to the machine frame, a first crank having one end fixedly connected to the torsion shaft and the other end hingedly connected to the tripod via a second link, and a second crank having one end fixedly connected to the torsion shaft and the other end hingedly connected to the slider via a first link; the power assembly outputs power, drives the screw to rotate, drives the nut to move via a screw thread pair transmission, and drives the slider to move up and down sequentially via the tripod, the second link, the first crank, the torsion shaft, the second crank and the first link.

Further, the drive mechanisms comprise a power assembly located on the machine frame, a third crank driven by the power assembly, a fourth link connected to a revolute pair of the third crank, a rotatable torsion shaft disposed perpendicular to a slider plate surface and hingedly connected to the machine frame, a first crank having one end hingedly connected to the fourth link and the other end fixedly connected to the torsion shaft, and a second crank having one end fixedly connected to the torsion shaft and the other end hingedly connected to the slider via a first link; the power assembly outputs power, drives the third crank to rotate, and drives the slider to move up and down sequentially via the fourth link, the first crank, the torsion shaft, the second crank and the first link.

Still further, the drive mechanisms comprise a power assembly located on the machine frame, a third crank driven by the power assembly, a fourth link connected to a revolute pair of the third crank, a tripod having one end hingedly connected to the fourth link and the other end hingedly connected to the machine frame, a rotatable torsion shaft disposed perpendicular to a slider plate surface and hingedly connected to the machine frame, a first crank having one end fixedly connected to the torsion shaft and the other end hingedly connected to the tripod via a second link, and a second crank having one end fixedly connected to the torsion shaft and the other end hingedly connected to the slider via a first link; the power assembly outputs power, drives the third crank to rotate, and drives the slider to move up and down sequentially via the fourth link, the tripod, the second link, the first crank, the torsion shaft, the second crank and the first link.

Preferably, the power assembly comprises a servo motor located on the machine frame, a small belt wheel located on an output shaft of the servo motor, a big belt wheel coaxially fixedly connected to the screw, and a synchronous belt winding on the small belt wheel and big belt wheel to perform transmission. Preferably, the power assembly comprise a servo motor located on the machine frame, a small belt wheel located on an output shaft of the servo motor, a big belt wheel coaxially fixedly connected to the third crank, and a synchronous belt winding on the small belt wheel and big belt wheel to perform transmission. Further, the machine frame is hingedly connected to a fixing base for configuring the power assembly; and the screw is hingedly connected to the fixing base via a bearing. Still further, the nut is hingedly connected to the first crank via a connecting base. Preferably, the nut is hingedly connected to the tripod via a connecting base. Beneficial effects: compared with the prior art, the present invention has the following notable advantages:

(1) The present invention makes full use of the nonlinear motion characteristic of the link mechanism, and adopts the drive mechanisms to realize the fast downward, machining and return actions of the bending machine according to the actual operating condition features of the numerical control bending machine, wherein in the fast downward and return stages, the drive mechanisms have the characteristics of fast speed and small load; and in the machining stage, the drive mechanisms have the characteristics of slow speed and high load; the present invention effectively improves performances, reduces cost, realizes high speed and heavy load, and has a great significance for promoting the development of the numerical control bending machine from the traditional hydraulic drive mode to the mechanical electric servo drive mode;

(2) In the present invention, owing to the nonlinear motion characteristic of the link mechanism, under the situation that the servo motor rotates at a constant speed, the link mechanism has relatively low speeds at the upper and lower dead points thereof, and has a relatively high speed at a middle position; the action is gentle, and has no impact;

(3) The present invention can greatly improve the power utilization ratio of the servo motor by utilizing the high speed light load and low speed heavy load nonlinear motion and mechanical characteristics, realizes a heavy load large tonnage bending machine, and overcomes the technical bottleneck in the industry;

(4) The present invention greatly improves the power utilization ratio of the servo motor; therefore, the bending machine at the same tonnage can adopt a smaller drive motor, and the expensive heavy load and high precision ball screw can be replaced with common components such as a crank, a link and the like; the present invention effectively reduces manufacturing cost, is maintenance free and highly reliable;

(5) The present invention utilizes the asynchronous operations of two left-right symmetrically arranged servo motors to adjust the parallel misalignment between the upper die and the lower die, such that the left and right sides of the slider are not in parallel, thus realizing tapered bending;

(6) In the present invention, the second crank and the first link are symmetrically arranged, and the horizontal component forces generated by the mechanism can counteract with each other, thus preventing the mechanism from bearing a lateral force; and (7) The force points of the mechanism of the invention, namely the hinge position of the torsion shaft and the machine frame, and the hinge point of the second crank and the machine frame, are both symmetric about the center of the machine frame side plate. Therefore, the machine frame side plate only bears the load in the plate surface direction to avoid warping under stress.

DETAILED DESCRIPTION OF THE PREFERRED EMBODIMENTS

The technical solution of the present invention will be further described hereafter in combination with the drawings.

Embodiment 1

Figure 1:
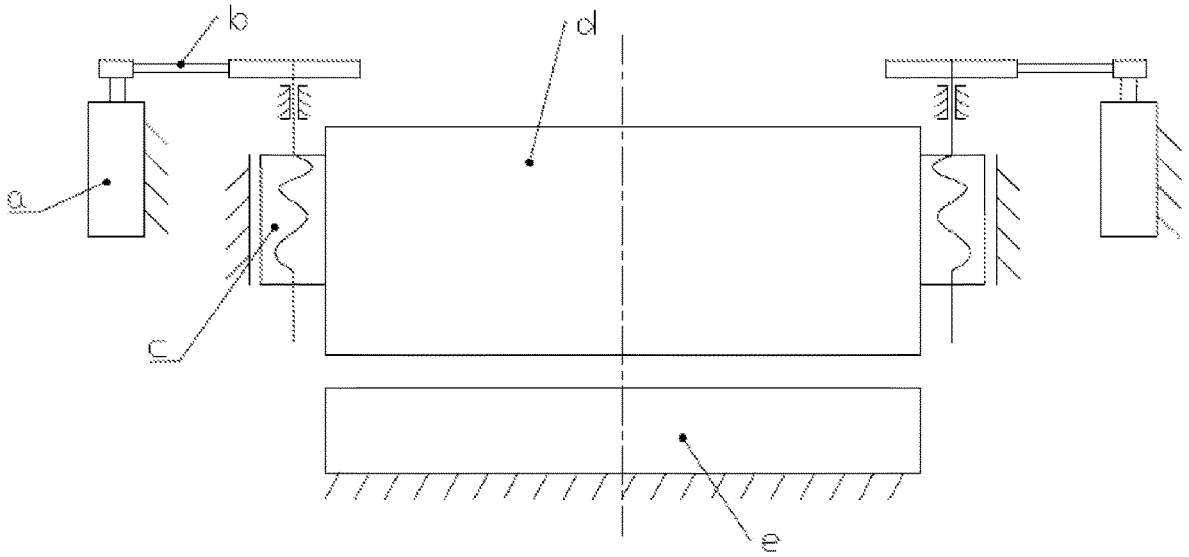
FIG. 1 is a structural schematic diagram of a bending machine in the prior art.
Figure 2:
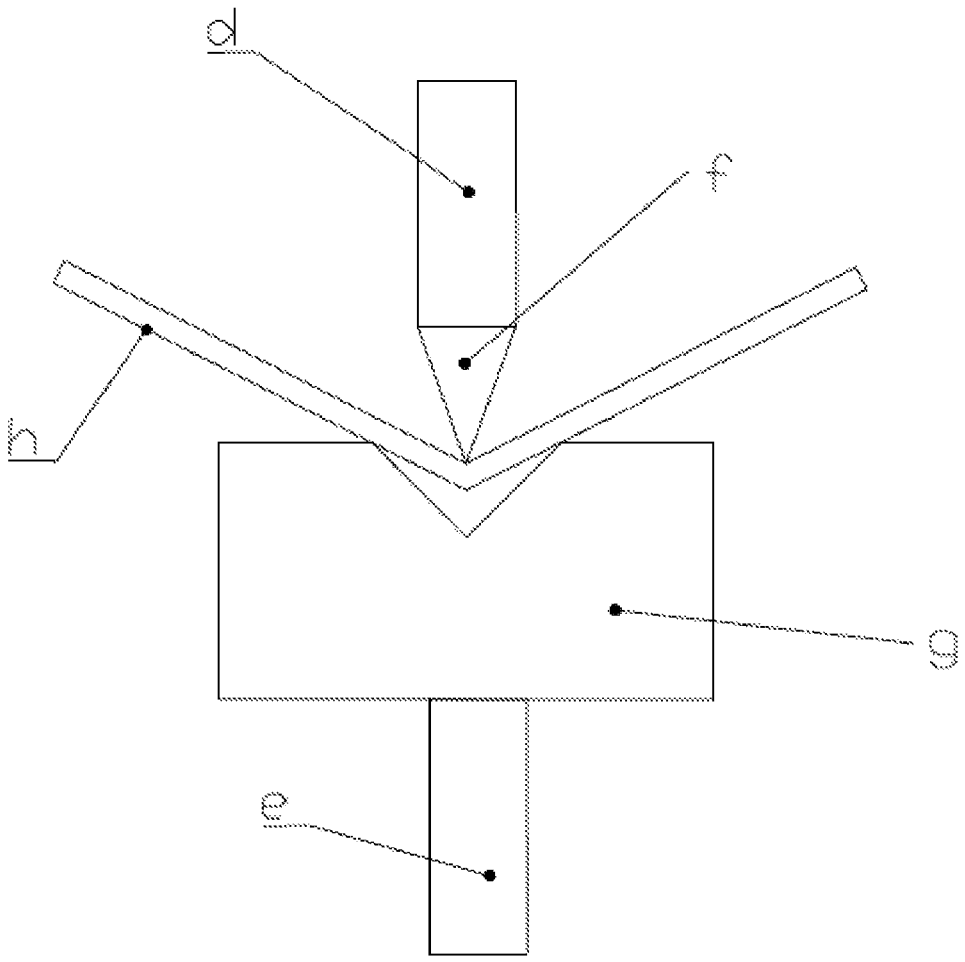
FIG. 2 is a schematic diagram how to bend a plate in the prior art.
Figure 3:
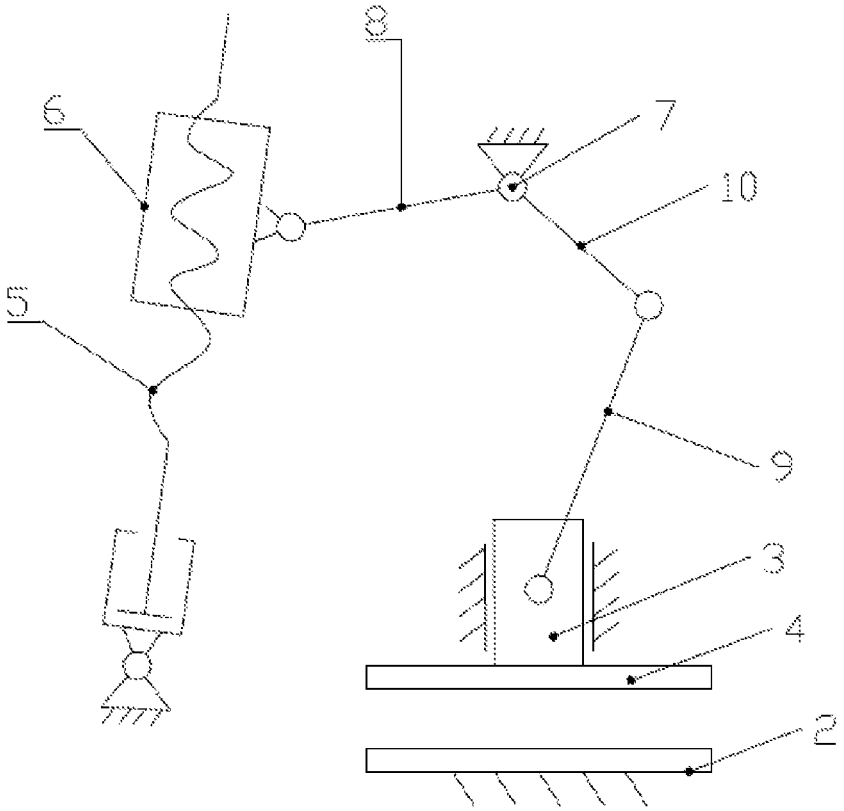
FIG. 3 is a schematic diagram of the embodiment 1 of the present invention.

As shown in FIG. 3, a torsion shaft structure based multi-link all-electric servo synchronous bending machine provided by the present invention comprises a machine frame 1, a lower die 2, a slider 3 and a lower die 4, wherein the slider 3 can move up and down along the machine frame 1; the upper die 4 is fixedly disposed on the slider 3; the lower die 2 is fixedly disposed on the machine frame 1; the upper die 4 and the lower die 2 cooperate with each other to realize bending; the machine frame 1 comprises two machine frame side plates which are symmetrically arranged, a machine frame bottom plate located at the bottom and used for fix the lower die, and a machine frame cross beam member for connecting the two machine frame side plates; and the cross section of the machine frame cross beam member is a U-shaped structure.

Figure 4:
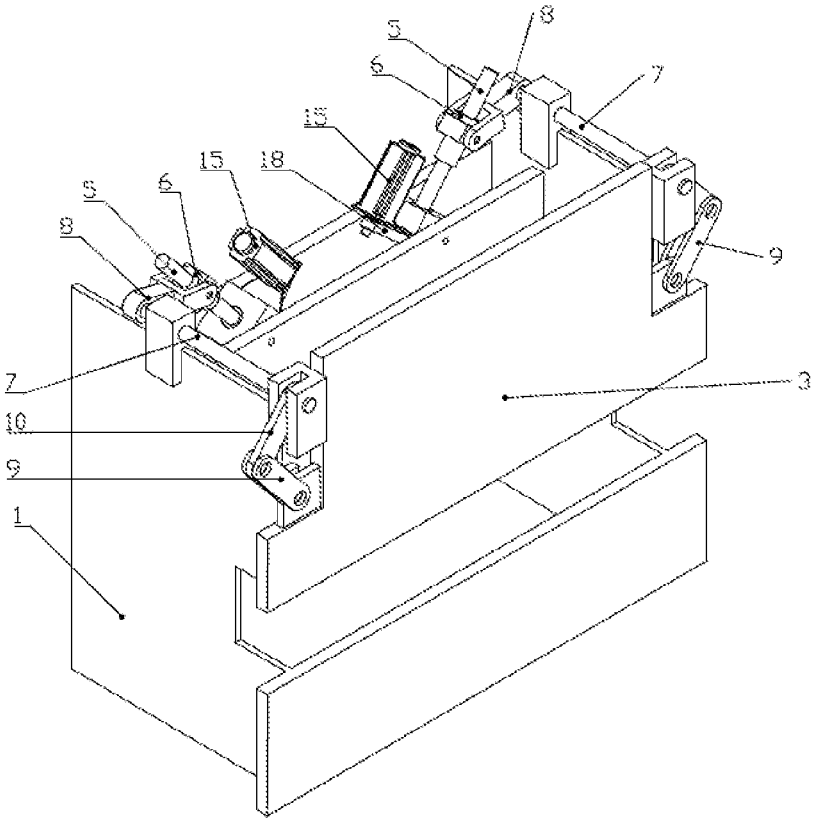
FIG. 4 is a structural schematic diagram I of the embodiment 1 of the present invention.
Figure 5:
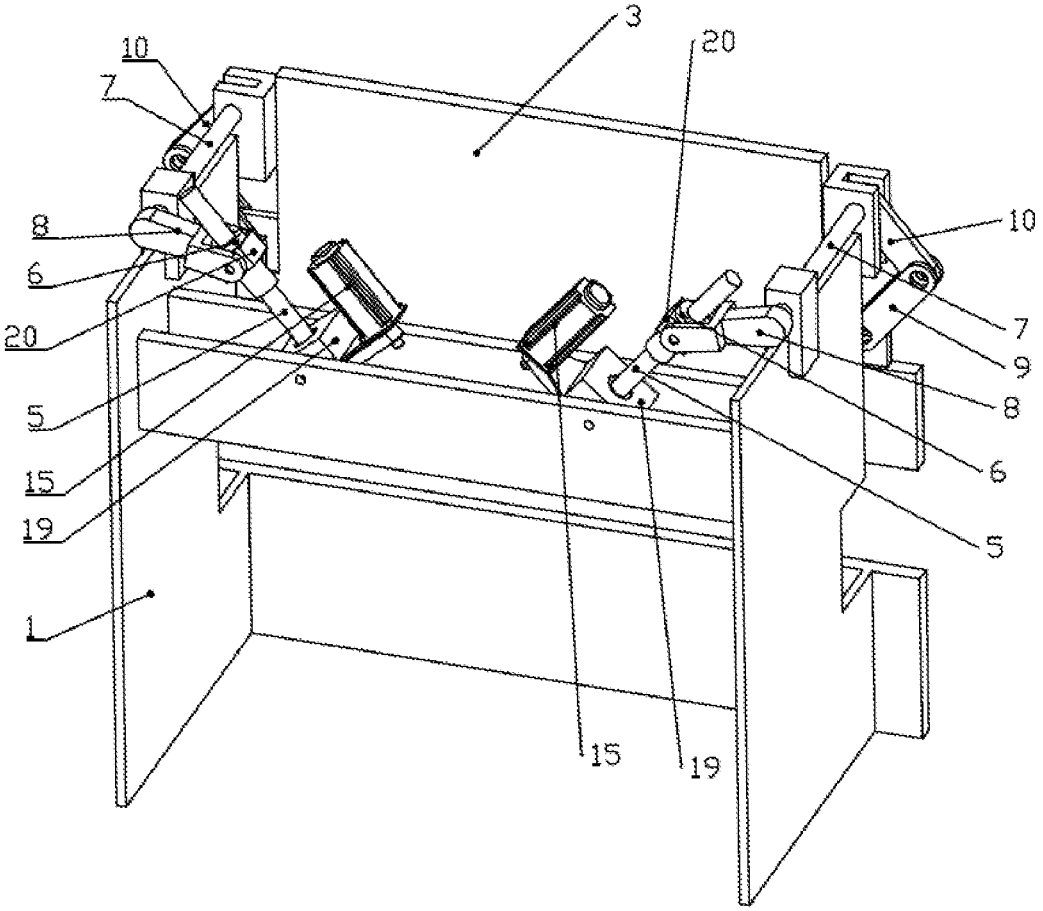
FIG. 5 is a structural schematic diagram II of the embodiment 1 of the present invention.
Figure 6:
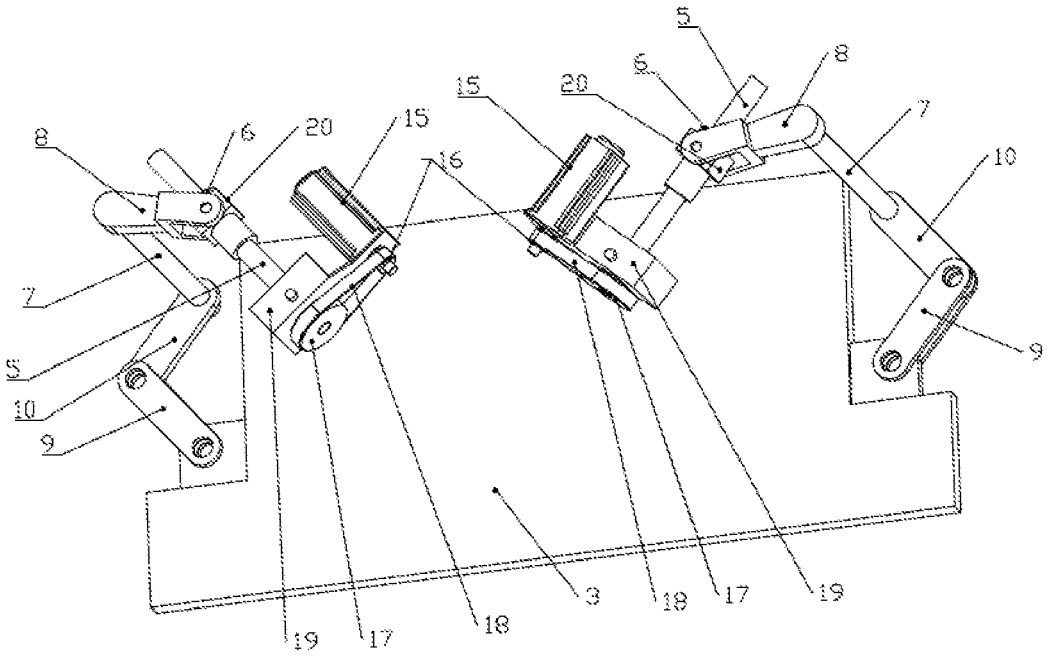
FIG. 6 is a structural schematic diagram of the embodiment 1 of the present invention having the machine frame removed.

As shown in FIGS. 4, 5 and 6, the slider 3 is left-right symmetrically connected to drive mechanisms for driving the slider to realize a transmission ratio adjustable motion; the drive mechanisms comprise a power assembly, a screw 5, a nut 6, a torsion shaft 7, a first crank 8, a first link 9 and a second crank 10; the machine frame 1 is hingedly connected to a fixing base 19; the screw 5 penetrates through the fixing base 19, and is hingedly connected to the fixing base 19 via a bearing;

the power assembly comprises a servo motor located on the fixing base 19, a small belt wheel 16 located on an output shaft of the servo motor, a big belt wheel 17 coaxially fixedly connected to the screw, and a synchronous belt 18 winding on the small belt wheel and big belt wheel to perform transmission; the screw 5 is coaxially fixedly connected to the big belt wheel 17, and is driven to rotate by the servo motor via a belt transmission; the nut 6 and the screw 5 are in thread fit; the nut 6 is fixedly connected to a connecting base 20; the connecting base 20 is hingedly connected to one end of the first crank 8; the other end of the first crank 8 is fixedly connected to one end of the torsion shaft; the other end of the torsion shaft is fixedly connected to one end of the second crank; the other end of the second crank is hingedly connected to the slider 3 via the first link 9; the servo motor outputs power, drives the big belt wheel to rotate together with the screw via a synchronous belt transmission, drives the nut 6 to move via a screw thread pair transmission, and drives the slider 3 to move up and down sequentially via the first crank 8, the torsion shaft 7, the second crank 10 and the first link 9. The present invention can utilize the asynchronous operations of two left-right symmetrically arranged servo motors to adjust the parallel misalignment between the upper die and the lower die, such that the left and right sides of the slider are not in parallel, thus realizing tapered bending.

Figure 19:
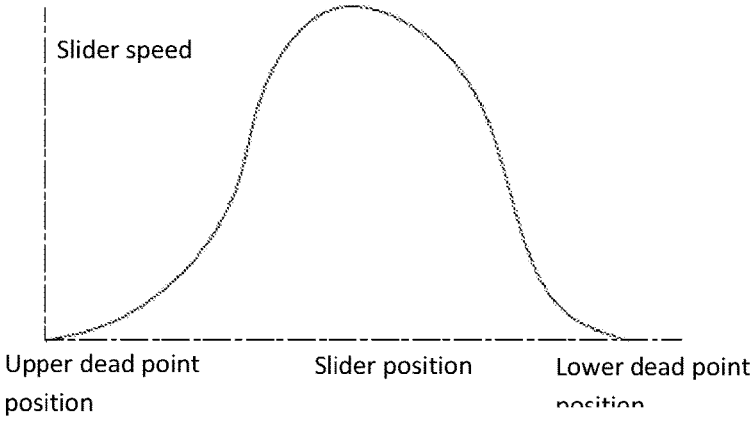
FIG. 19 is a schematic diagram of the nonlinear motion characteristic of the link mechanism in the present invention.
Figure 20:
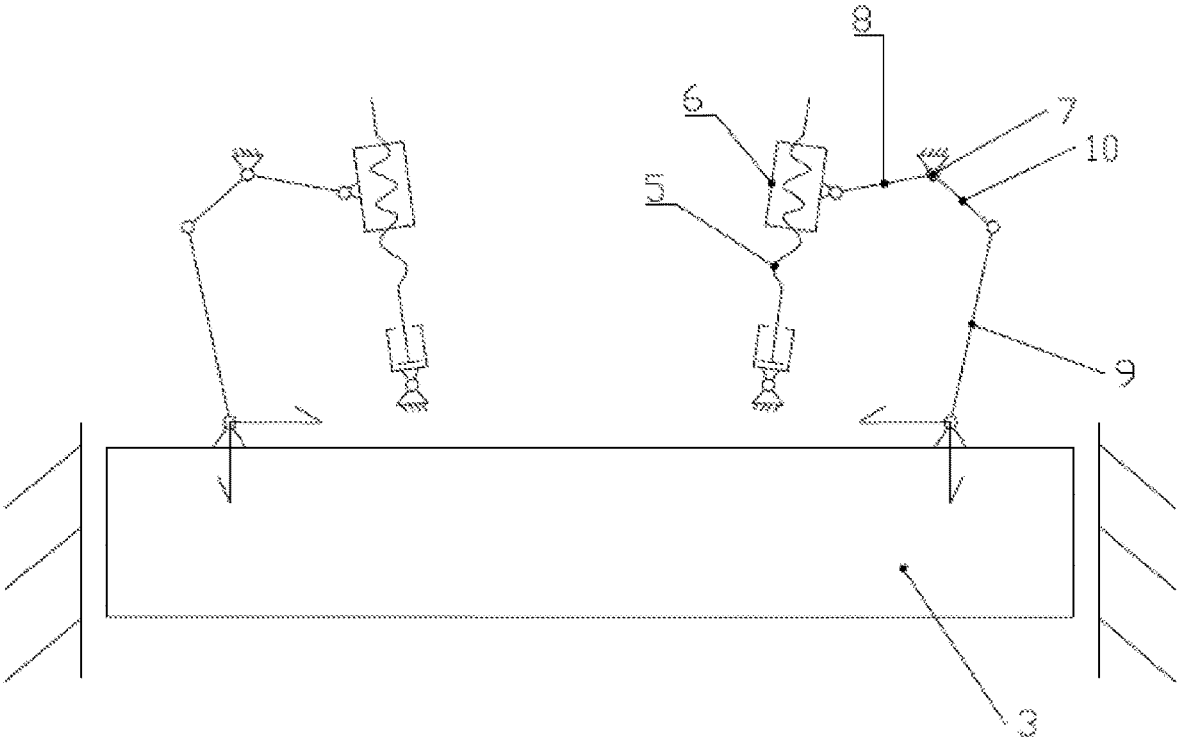
FIG. 20 is a force diagram of slider in the present invention.

As shown in FIG. 19, the operating mode of the bending machine is a typical variable speed and variable load operating mode. The fast downward and return stage thereof is a high speed, low load and long stroke motion stage; and the machining stage is a low speed, high load and short stroke motion stage. Therefore, when the slider is at an upper dead point or a lower dead point, the mechanism is at a self-locking position; the present invention makes full use of the above characteristic and the typical nonlinear motion characteristic of the link mechanism to realize high speed motion and low load output in a non-machining stroke, that is, the fast downward and return stage, and realize heavy load output and low speed motion in the machining stroke, thus greatly reducing the power of a drive motor, and solving the problem that the transmission ratio in a ball screw drive mode cannot be adjusted. The present invention can amplify the driving force of the screw by 3-5 times via the link mechanism, and can realize a large tonnage mechanical electric servo bending machine. As shown in FIG. 20, in the present invention, the second crank and the first link are symmetrically arranged, and the horizontal component forces generated by the mechanism can counteract with each other, thus preventing the mechanism from bearing a lateral force.

Embodiment 2

Figure 7:
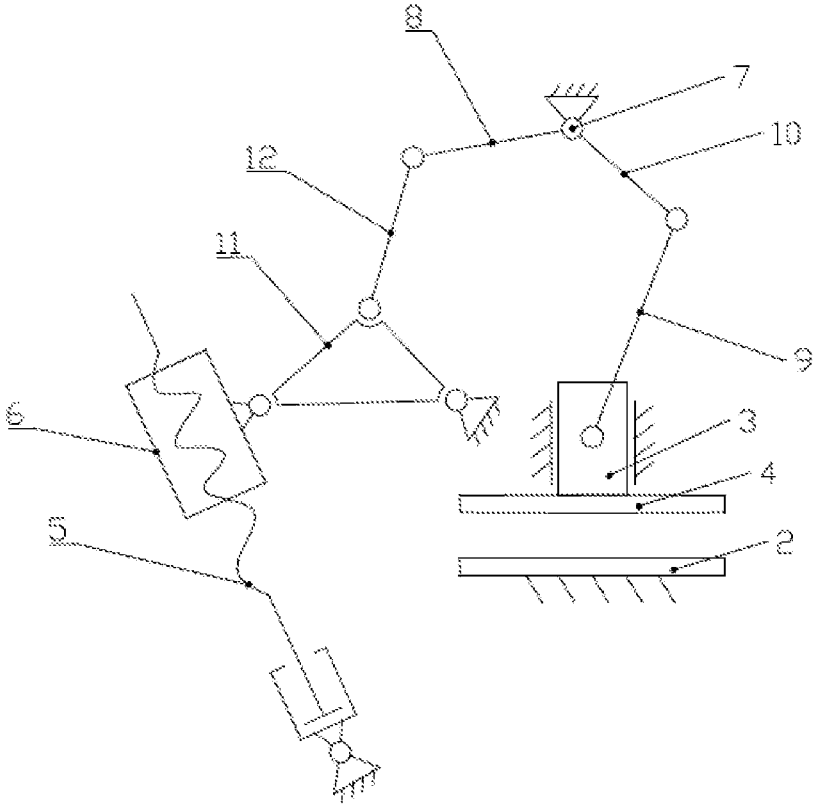
FIG. 7 is a schematic diagram of the embodiment 2 of the present invention.

As shown in FIG. 7, a torsion shaft structure based multi-link all-electric servo synchronous bending machine provided by the present invention comprises a machine frame 1, a lower die 2, a slider 3 and a lower die 4, wherein the slider 3 can move up and down along the machine frame 1; the upper die 4 is fixedly disposed on the slider 3; the lower die 2 is fixedly disposed on the machine frame 1; the upper die 4 and the lower die 2 cooperate with each other to realize bending; the machine frame 1 comprises two machine frame side plates which are symmetrically arranged, a machine frame bottom plate located at the bottom and used to fix the lower die, and a machine frame cross beam member for connecting the two machine frame side plates; and the cross section of the machine frame cross beam member is a U-shaped structure.

Figure 8:
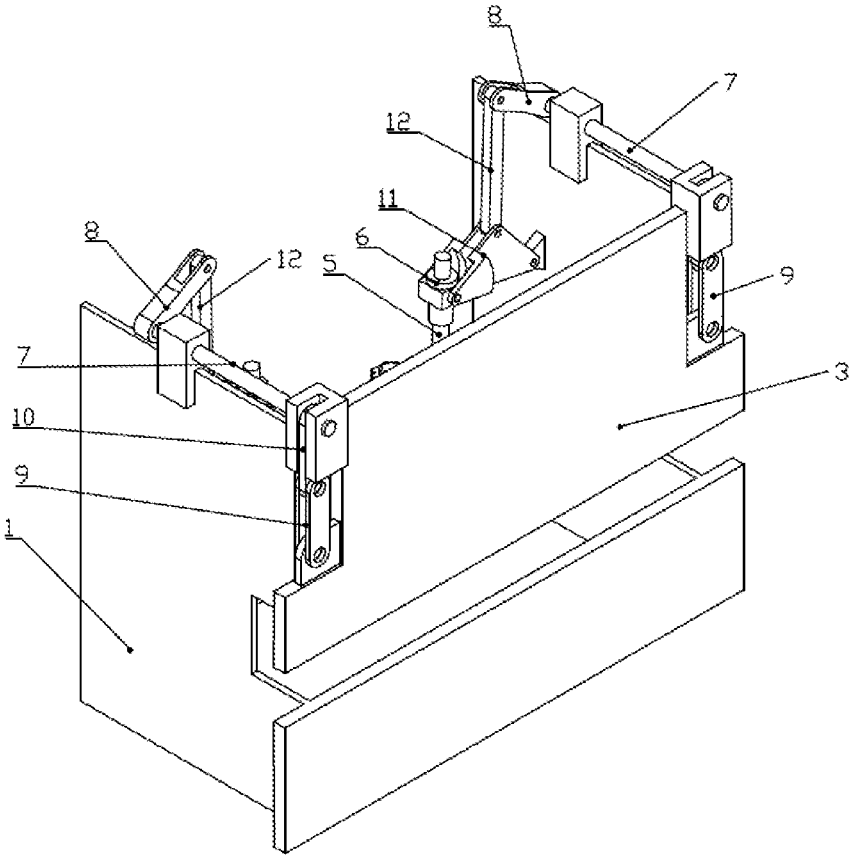
FIG. 8 is a structural schematic diagram I of the embodiment 2 of the present invention.
Figure 9:
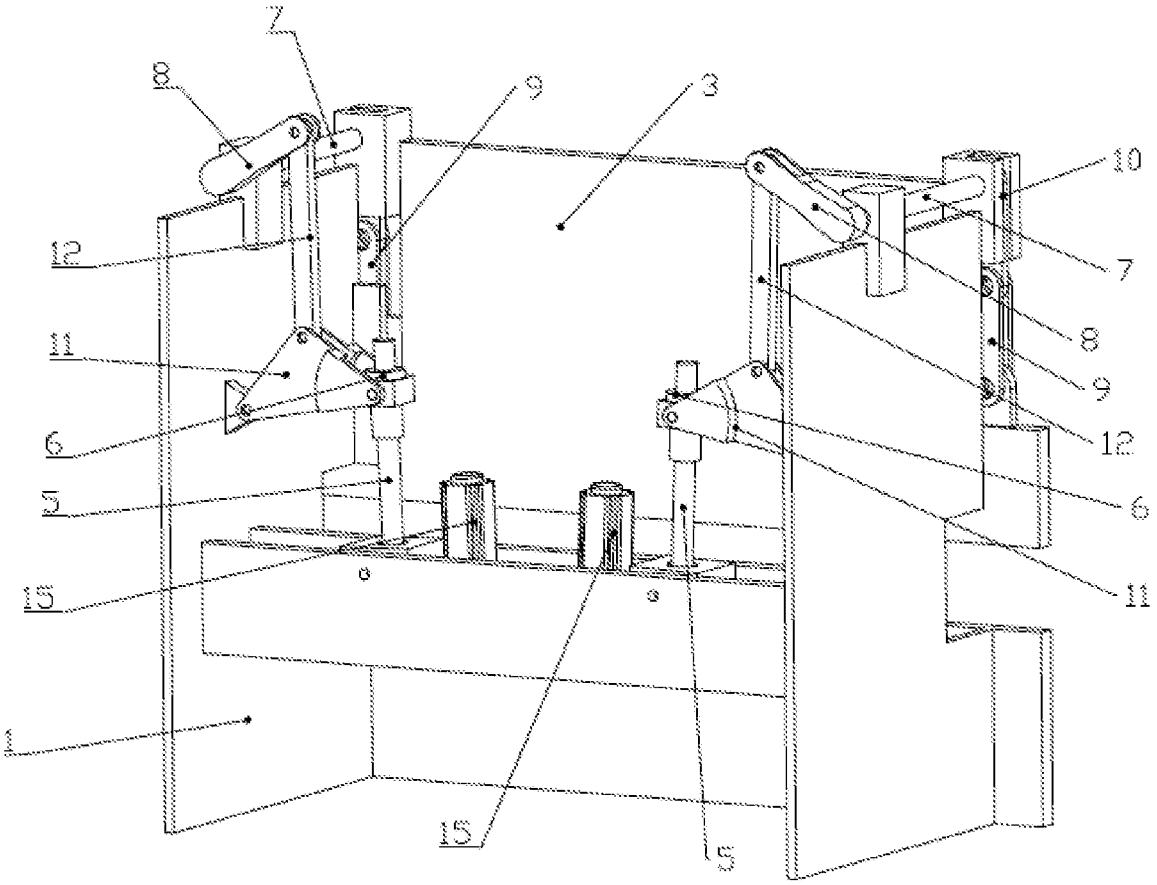
FIG. 9 is a structural schematic diagram II of the embodiment 2 of the present invention.
Figure 10:
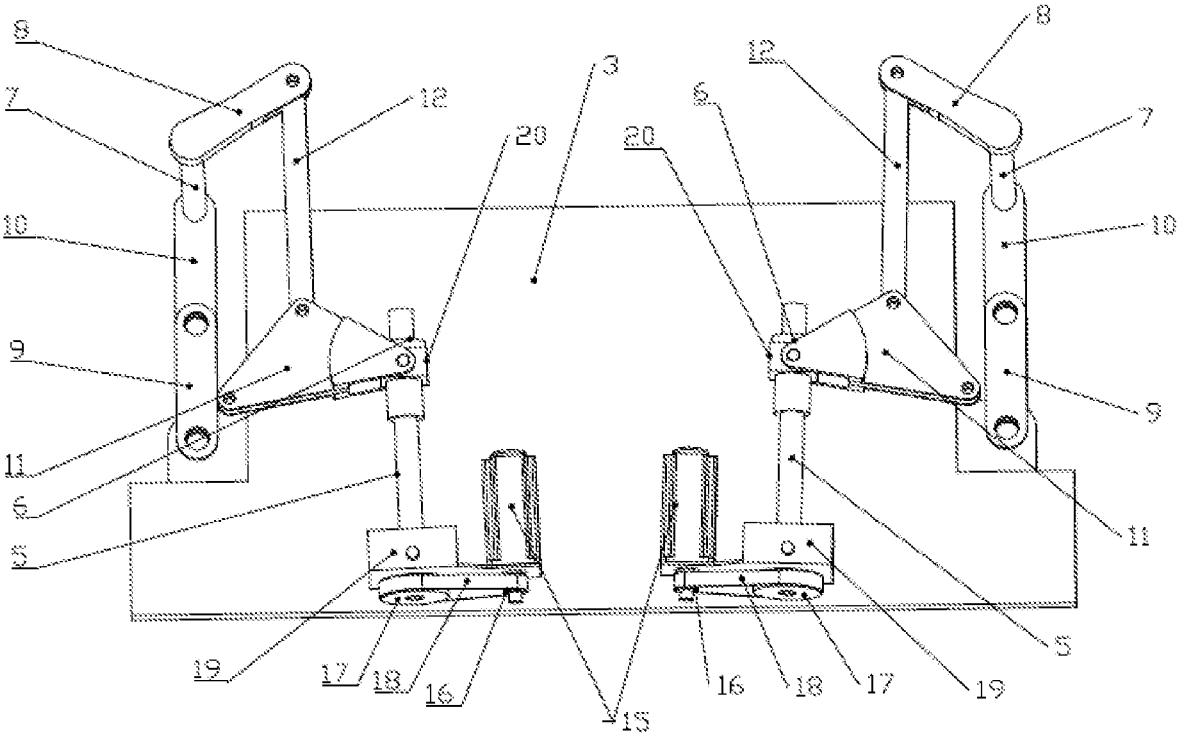
FIG. 10 is a structural schematic diagram of the embodiment 2 of the present invention having the machine frame removed.

As shown in FIGS. 8, 9 and 10, the slider 3 is left-right symmetrically connected to drive mechanisms for driving the slider to realize a transmission ratio adjustable motion; the drive mechanisms comprise a power assembly, a screw 5, a nut 6, a torsion shaft 7, a first crank 8, a first link 9, a second crank 10, a tripod 11 and a second link 12; the machine frame 1 is hingedly connected to a fixing base 19; the screw 5 penetrates through the fixing base 19, and is hingedly connected to the fixing base 19 via a bearing; the power assembly comprises a servo motor located on the fixing base 19, a small belt wheel 16 located on an output shaft of the servo motor, a big belt wheel 17 coaxially fixedly connected to the screw, and a synchronous belt 18 winding on the small belt wheel and big belt wheel to perform transmission;

the power assembly of the present invention is located at the lower part of the machine frame, has a low center of gravity, and effectively improve the stability of the whole bending machine; the screw 5 is coaxially fixedly connected to the big belt wheel 17, and is driven to rotate by the servo motor via a belt transmission; the nut 6 and the screw 5 are in thread fit; the nut 6 is fixedly connected to a connecting base 20; the connecting base 20 is hingedly connected to one end of the tripod 11; one end of the tripod 11 is hingedly connected to the machine frame, and the other end of the tripod 11 is hingedly connected to one end of the second link 12; the other end of the second link 12 is hingedly connected to one end of the first crank 8; the other end of the first crank 8 is fixedly connected to one end of the torsion shaft; the other end of the torsion shaft is fixedly connected to one end of the second crank; the other end of the second crank is hingedly connected to the slider 3 via the first link 9; the servo motor outputs power, drives the big belt wheel to rotate together with the screw via a synchronous belt transmission, drives the nut 6 to move via a screw thread pair transmission, and drives the slider 3 to move up and down sequentially via the tripod 11, the second link 12, the first crank 8, the torsion shaft 7, the second crank 10 and the first link 9. The present invention can utilize the asynchronous operations of two left-right symmetrically arranged servo motors to adjust the parallel misalignment between the upper die and the lower die, such that the left and right sides of the slider are not in parallel, thus realizing tapered bending.

As shown in FIG. 19, the operating mode of the bending machine is a typical variable speed and variable load operating mode. The fast downward and return stage thereof is a high speed, low load and long stroke motion stage; and the machining stage is a low speed, high load and short stroke motion stage. Therefore, when the slider is at an upper dead point or a lower dead point, the mechanism is at a self-locking position; the present invention makes full use of the above characteristic and the typical nonlinear motion characteristic of the link mechanism to realize high speed motion and low load output in a non-machining stroke, that is, the fast downward and return stage, and realize heavy load output and low speed motion in the machining stroke, thus greatly reducing the power of a drive motor, and solving the problem that the transmission ratio in a ball screw drive mode cannot be adjusted. The present invention can amplify the driving force of the screw by 3-5 times via the link mechanism, and can realize a large tonnage mechanical electric servo bending machine.

Embodiment 3

Figure 11:
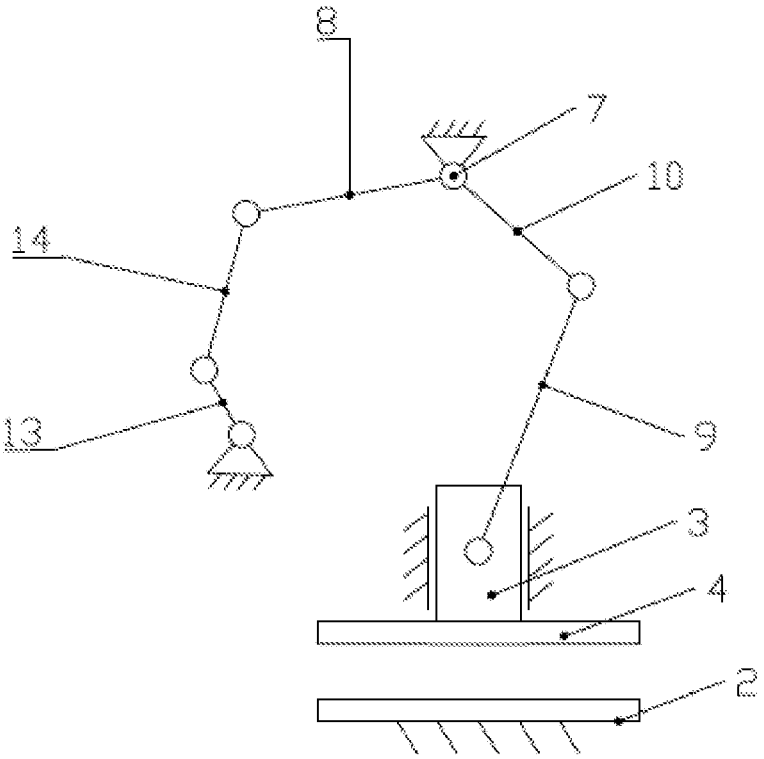
FIG. 11 is a schematic diagram of the embodiment 3 of the present invention.

As shown in FIG. 11, a torsion shaft structure based multi-link all-electric servo synchronous bending machine provided by the present invention comprises a machine frame 1, a lower die 2, a slider 3 and a lower die 4, wherein the slider 3 can move up and down along the machine frame 1; the upper die 4 is fixedly disposed on the slider 3; the lower die 2 is fixedly disposed on the machine frame 1; the upper die 4 and the lower die 2 cooperate with each other to realize bending; the machine frame 1 comprises two machine frame side plates which are symmetrically arranged, a machine frame bottom plate located at the bottom and used for fix the lower die, and a machine frame cross beam member for connecting the two machine frame side plates; and the cross section of the machine frame cross beam member is a U-shaped structure.

Figure 12:
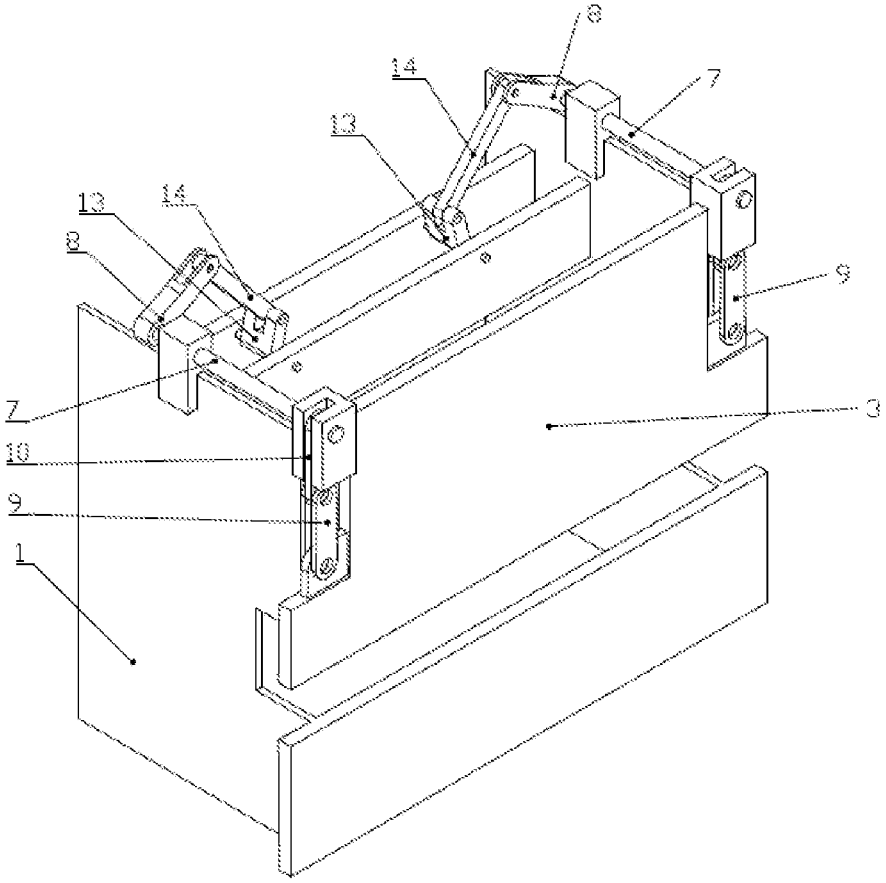
FIG. 12 is a structural schematic diagram I of the embodiment 3 of the present invention.
Figure 13:
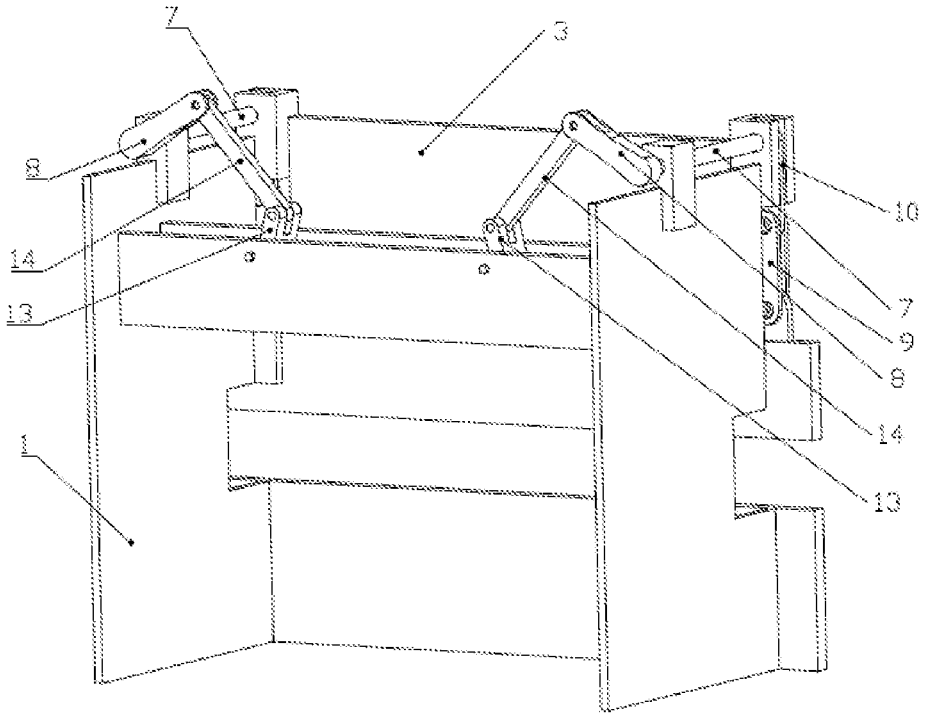
FIG. 13 is a structural schematic diagram II of the embodiment 3 of the present invention.
Figure 14:
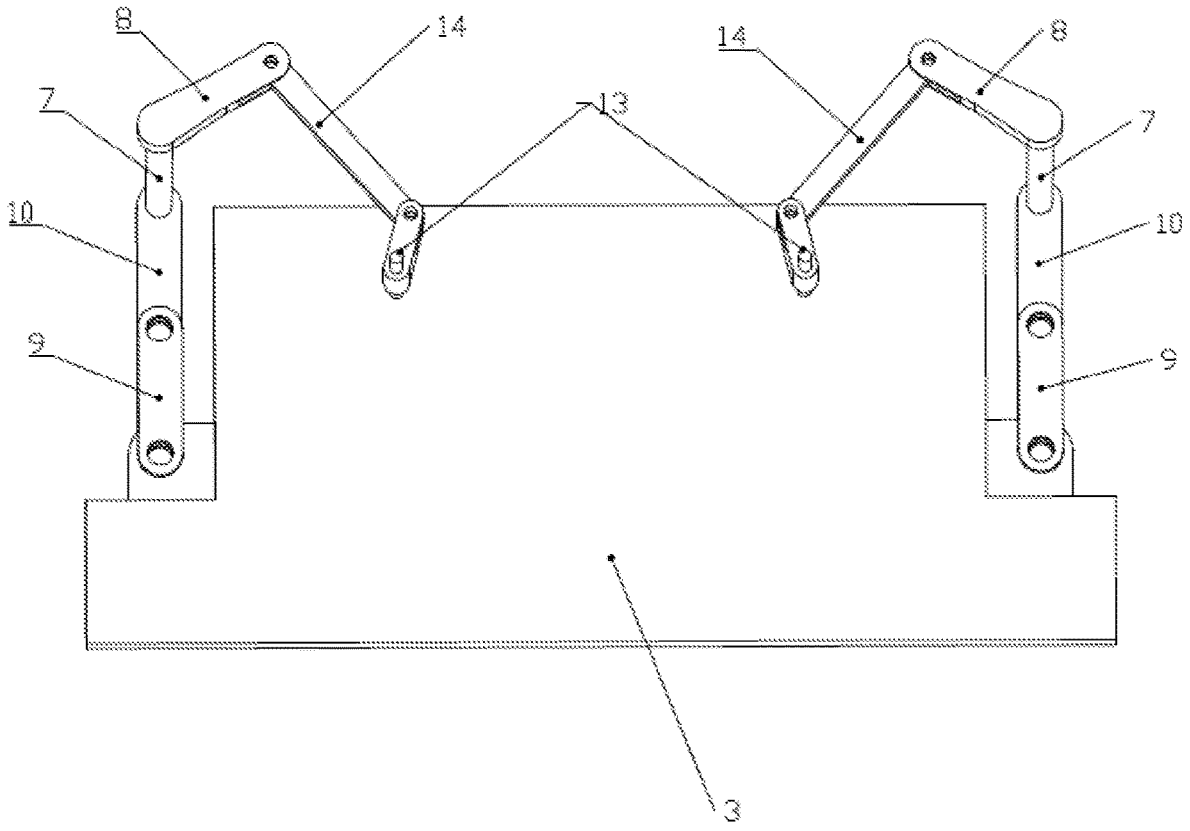
FIG. 14 is a structural schematic diagram of the embodiment 3 of the present invention having the machine frame removed.

As shown in FIGS. 12, 13 and 14, the slider 3 is left-right symmetrically connected to drive mechanisms for driving the slider to realize a transmission ratio adjustable motion; the drive mechanisms comprise a power assembly, a third crank 13, a fourth link 14, a torsion shaft 7, a first crank 8, a first link 9 and a second crank 10; the power assembly comprises a servo motor, a small belt wheel 16 located on an output shaft of the servo motor, a big belt wheel 17 coaxially fixedly connected to the third crank, and a synchronous belt 18 winding on the small belt wheel and big belt wheel to perform transmission; the third crank 13 is coaxially fixedly connected to the big belt wheel 17, and is driven to rotate by the servo motor via a belt transmission; alternatively, the third crank 13 is directly disposed on the output shaft of the servo motor, and is directly driven to rotate by the servo motor;

the third crank 13 is connected to a revolute pair at one end of the fourth link 14; the other end of the fourth link 14 is hingedly connected to one end of the first crank 8; the other end of the first crank 8 is fixedly connected to one end of the torsion shaft; the other end of the torsion shaft is fixedly connected to one end of the second crank; the other end of the second crank is hingedly connected to the slider 3 via the first link 9; the servo motor outputs power, drives the big belt wheel to rotate together with the third crank 13 via a synchronous belt transmission, drives the fourth link move via the revolute pair, and drives the slider 3 to move up and down sequentially via the first crank 8, the torsion shaft 7, the second crank 10 and the first link 9. The present invention can utilize the asynchronous operations of two left-right symmetrically arranged servo motors to adjust the parallel misalignment between the upper die and the lower die, such that the left and right sides of the slider are not in parallel, thus realizing tapered bending.

As shown in FIG. 19, the operating mode of the bending machine is a typical variable speed and variable load operating mode. The fast downward and return stage thereof is a high speed, low load and long stroke motion stage; and the machining stage is a low speed, high load and short stroke motion stage. Therefore, when the slider is at an upper dead point or a lower dead point, the mechanism is at a self-locking position; the present invention makes full use of the above characteristic and the typical nonlinear motion characteristic of the link mechanism to realize high speed motion and low load output in a non-machining stroke, that is, the fast downward and return stage, and realize heavy load output and low speed motion in the machining stroke, thus greatly reducing the power of a drive motor, and solving the problem that the transmission ratio in a ball screw drive mode cannot be adjusted. The present invention can amplify the driving force of the screw by 3-5 times via the link mechanism, and can realize a large tonnage mechanical electric servo bending machine.

Embodiment 4

Figure 15:
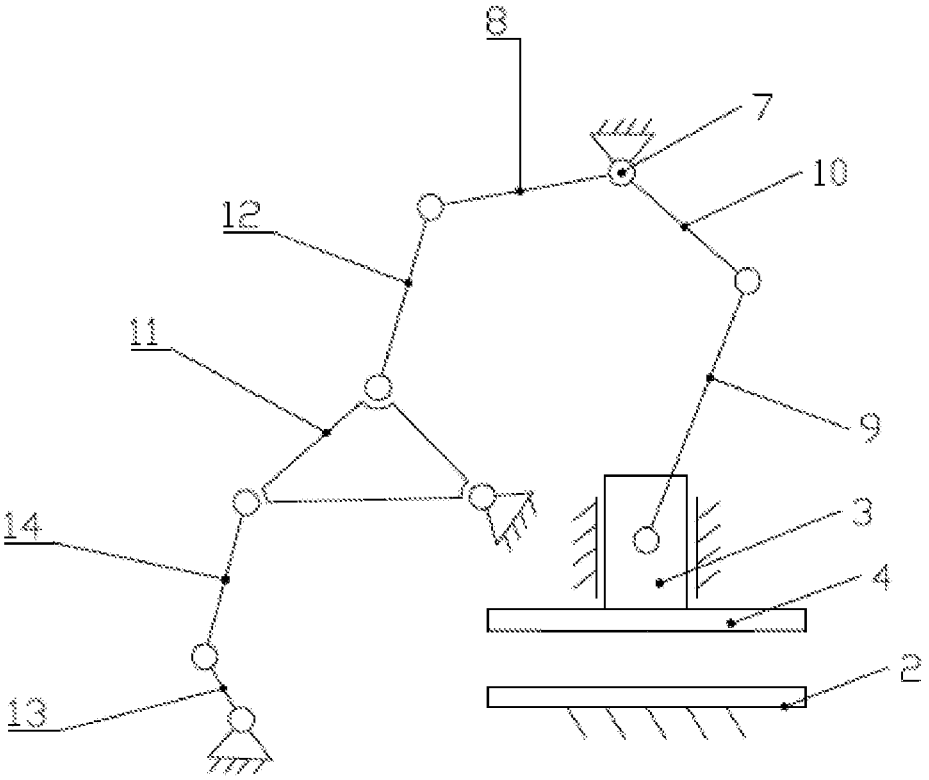
FIG. 15 is a schematic diagram of the embodiment 4 of the present invention.

As shown in FIG. 15, a torsion shaft structure based multi-link all-electric servo synchronous bending machine provided by the present invention comprises a machine frame 1, a lower die 2, a slider 3 and a lower die 4, wherein the slider 3 can move up and down along the machine frame 1; the upper die 4 is fixedly disposed on the slider 3; the lower die 2 is fixedly disposed on the machine frame 1; the upper die 4 and the lower die 2 cooperate with each other to realize bending; the machine frame 1 comprises two machine frame side plates which are symmetrically arranged, a machine frame bottom plate located at the bottom and used for fix the lower die, and a machine frame cross beam member for connecting the two machine frame side plates; and the cross section of the machine frame cross beam member is a U-shaped structure.

Figure 16:
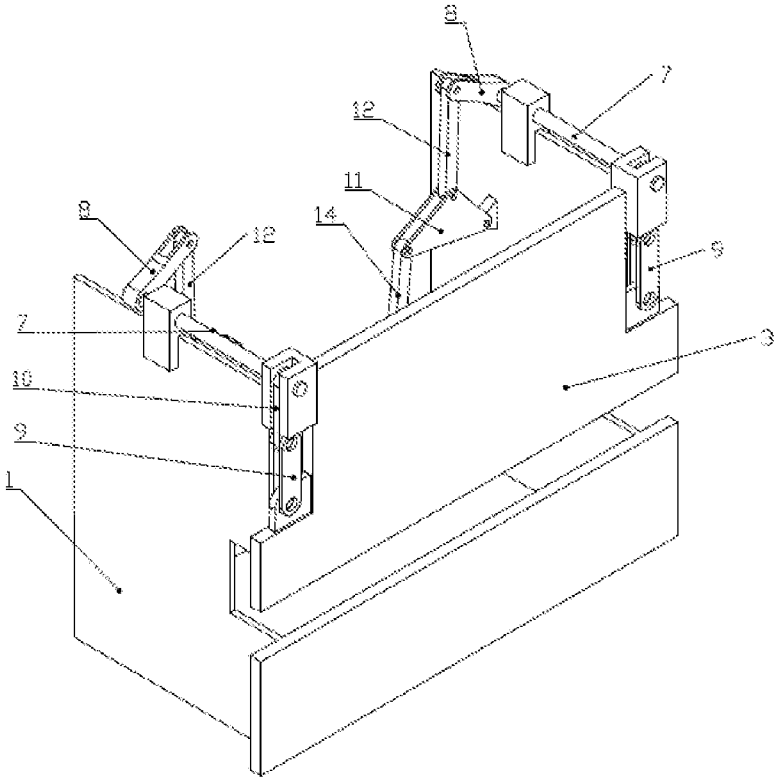
FIG. 16 is a structural schematic diagram I of the embodiment 4 of the present invention.
Figure 17:
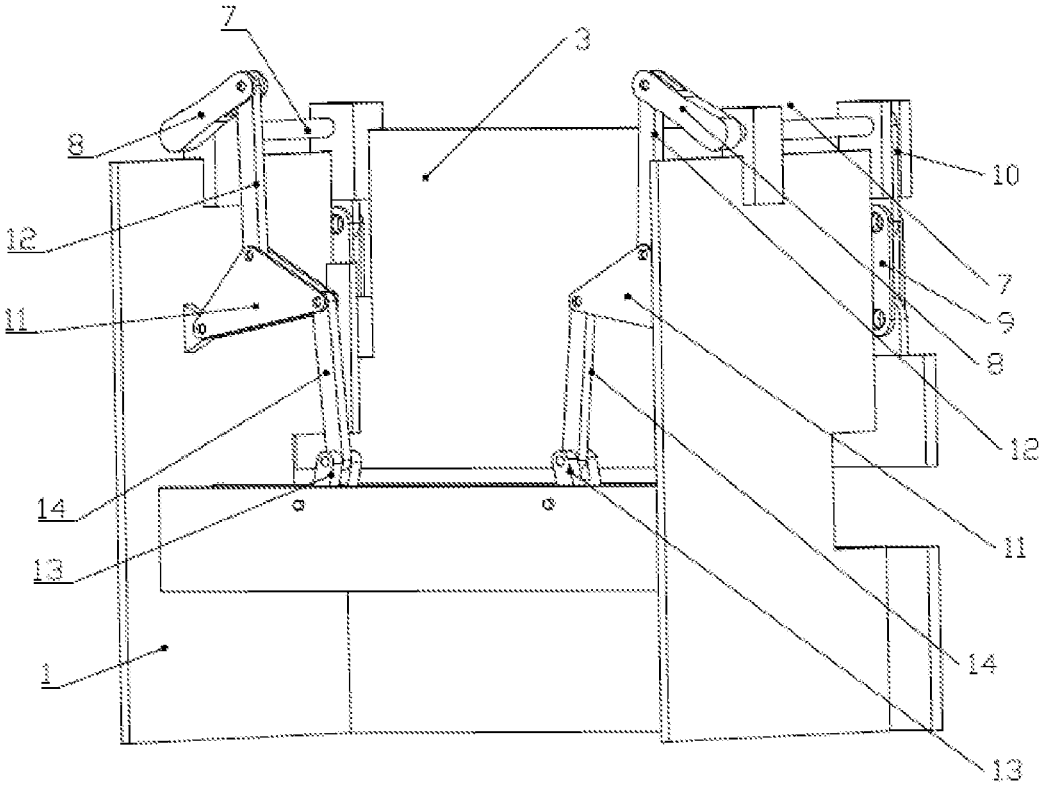
FIG. 17 is a structural schematic diagram II of the embodiment 4 of the present invention.
Figure 18:
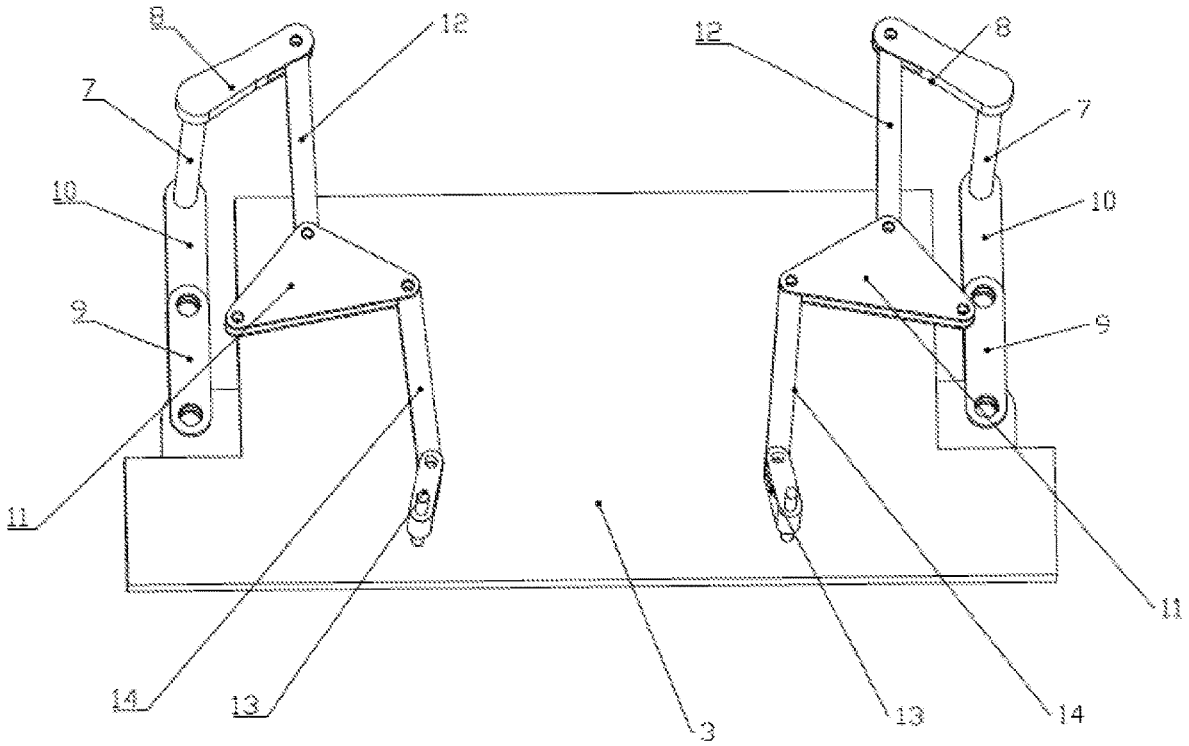
FIG. 18 is a structural schematic diagram of the embodiment 4 of the present invention having the machine frame removed.

As shown in FIGS. 16, 17 and 18, the slider 3 is left-right symmetrically connected to drive mechanisms for driving the slider to realize a transmission ratio adjustable motion; the drive mechanisms comprise a power assembly, a third crank 13, a fourth link 14, a torsion shaft 7, a first crank 8, a first link 9, a second crank 10, the tripod 11 and the second link 12; the power assembly comprises a servo motor, a small belt wheel 16 located on an output shaft of the servo motor, a big belt wheel 17 coaxially fixedly connected to the third crank, and a synchronous belt 18 winding on the small belt wheel and big belt wheel to perform transmission; the third crank 13 is coaxially fixedly connected to the big belt wheel 17, and is driven to rotate by the servo motor via a belt transmission; alternatively, the third crank 13 is directly disposed on the output shaft of the servo motor, and is directly driven to rotate by the servo motor; the third crank 13 is connected to a revolute pair at one end of the fourth link 14; the other end of the fourth link 14 is hingedly connected to one end of the tripod 11; one end of the tripod 11 is hingedly connected to the machine frame, and the other end of the tripod 11 is hingedly connected to one end of the second link 12;

the other end of the second link 12 is hingedly connected to one end of the first crank 8; the other end of the first crank 8 is fixedly connected to one end of the torsion shaft; the other end of the torsion shaft is fixedly connected to one end of the second crank; the other end of the second crank is hingedly connected to the slider 3 via the first link 9; the servo motor outputs power, drives the big belt wheel to rotate together with the third crank via a synchronous belt transmission, drives the fourth link 14 move via the revolute pair, and drives the slider 3 to move up and down sequentially via the tripod 11, the second link 12, the first crank 8, the torsion shaft 7, the second crank 10 and the first link 9. The present invention can utilize the asynchronous operations of two left-right symmetrically arranged servo motors to adjust the parallel misalignment between the upper die and the lower die, such that the left and right sides of the slider are not in parallel, thus realizing tapered bending.

As shown in FIG. 19, the operating mode of the bending machine is a typical variable speed and variable load operating mode. The fast downward and return stage thereof is a high speed, low load and long stroke motion stage; and the machining stage is a low speed, high load and short stroke motion stage. Therefore, when the slider is at an upper dead point or a lower dead point, the mechanism is at a self-locking position; the present invention makes full use of the above characteristic and the typical nonlinear motion characteristic of the link mechanism to realize high speed motion and low load output in a non-machining stroke, that is, the fast downward and return stage, and realize heavy load output and low speed motion in the machining stroke, thus greatly reducing the power of a drive motor, and solving the problem that the transmission ratio in a ball screw drive mode cannot be adjusted. The present invention can amplify the driving force of the screw by 3-5 times via the link mechanism, and can realize a large tonnage mechanical electric servo bending machine.

What is claimed is:

1. A torsion shaft structure comprising a machine frame (1), a lower die (2) fixedly connected to the machine frame and used for bending, a slider (3) capable of moving up and down along the machine frame, and an upper die (4) fixedly connected to the slider and cooperating with the lower die to perform bending, wherein the slider (3) is connected to two separate and distinct drive mechanisms which are driving the slider to realize a nonlinear motion characteristic; wherein a drive mechanism comprise a power assembly located on the machine frame, a screw (5) driven by the power assembly, a nut (6) in thread fit with the screw, a rotatable torsion shaft (7) disposed perpendicular to a plate surface of the slider and hingedly connected to the machine frame, a first crank (8) having one end hingedly connected to the nut and the other end fixedly connected to the torsion shaft, and a second crank (10) having one end fixedly connected to the torsion shaft and the other end hingedly connected to the slider via a first link (9), wherein the power assembly is configured to output to drive the screw (5) to rotate, drives the nut (6) to move via a screw thread pair transmission, and drives the slider (3) to move up and down sequentially via the first crank (8), the torsion shaft (7), the second crank (10) and the first link (9).

2. The torsion shaft structure according to claim 1, wherein the power assembly comprises a servo motor (15) located on the machine frame, a small belt wheel (16) located on an output shaft of the servo motor, a big belt wheel (17) coaxially fixedly connected to the screw, and a synchronous belt (18) winding on the small belt wheel and big belt wheel to perform transmission; wherein the small belt wheel has a smaller diameter than the big belt wheel.

3. The torsion shaft structure according to claim 1, wherein the machine frame (1) is hingedly connected to a fixing base (19) for configuring the power assembly; and the screw (5) is hingedly connected to the fixing base (19) via a bearing.

4. The torsion shaft structure according to claim 1, wherein the nut (6) is hingedly connected to the first crank (8) via a connecting base (20).

5. The torsion shaft structure according to claim 1, wherein the hinge position of the torsion shaft & the machine frame and the hinge point of the second crank & the machine frame are symmetric at the center of side plate of the machine frame.

* * * * *